US009027445B2

(12) United States Patent
Sumg

(10) Patent No.: US 9,027,445 B2
(45) Date of Patent: May 12, 2015

(54) SOCKET WITH A REINFORCED STRENGTH

(71) Applicant: Li-Yuan Sumg, Taichung (TW)

(72) Inventor: Li-Yuan Sumg, Taichung (TW)

( * ) Notice: Subject to any disclaimer, the term of this patent is extended or adjusted under 35 U.S.C. 154(b) by 217 days.

(21) Appl. No.: 13/729,193

(22) Filed: Dec. 28, 2012

(65) Prior Publication Data

US 2013/0319186 A1 Dec. 5, 2013

(30) Foreign Application Priority Data

Jun. 5, 2012 (TW) ..... 101120101 A

(51) Int. Cl.

| | |
|---|---|
| ***B25B 13/06*** | (2006.01) |
| ***B25B 23/00*** | (2006.01) |
| ***B25B 13/58*** | (2006.01) |
| *B25B 23/12* | (2006.01) |
| *B25B 13/02* | (2006.01) |
| *B25B 13/48* | (2006.01) |

(52) U.S. Cl.

CPC ..... *B25B 13/06* (2013.01); *B25B 23/12* (2013.01); *B25B 23/00* (2013.01); *B25B 13/065* (2013.01); *B25B 13/02* (2013.01); *B25B 13/48* (2013.01); *B25B 13/58* (2013.01)

(58) Field of Classification Search

CPC ..... B25B 13/06; B25B 13/065; B25B 13/48; B25B 13/5091; B25B 13/02; B25B 23/12; B25B 23/00

USPC ..... 81/121.1, 120, 125, 124.2, 124.6

See application file for complete search history.

(56) References Cited

U.S. PATENT DOCUMENTS

| | | | | |
|---|---|---|---|---|
| 5,782,148 | A * | 7/1998 | Kerkhoven | 81/124.6 |
| 7,270,034 | B2 * | 9/2007 | Hu | 81/124.3 |
| 7,841,261 | B2 * | 11/2010 | Milligan et al. | 81/121.1 |
| 8,516,930 | B2 * | 8/2013 | Tsai | 81/124.6 |
| 2009/0064825 | A1 * | 3/2009 | Milligan et al. | 81/121.1 |
| 2014/0053692 | A1 * | 2/2014 | Hu | 81/121.1 |

* cited by examiner

*Primary Examiner* — Lee D Wilson
*Assistant Examiner* — Melanie Alexander
(74) *Attorney, Agent, or Firm* — Alan D. Kamrath; Kamrath IP Lawfirm, P.A.

(57) ABSTRACT

A socket includes a body and a sleeve. The body is made of metal and includes first and second coupling ends for respectively coupling with a fastener and a driving tool. The first coupling end includes an outer periphery having a first protruded section, a second protruded section, and an engagement section extending between the first and second protruded sections. The sleeve is made of metal having a hardness greater than a hardness of the body. The sleeve includes an inner periphery extending between first and second end faces of the sleeve. The inner periphery of the sleeve includes an engagement portion engaged with the engagement section of the body, with the sleeve not contacting the first and second protruded sections.

11 Claims, 4 Drawing Sheets

SOCKET WITH A REINFORCED STRENGTH

BACKGROUND OF THE INVENTION

The present invention relates to a socket with a reinforced strength and, more particularly, to a socket including a body and a sleeve having a hardness greater than that of the body to increase the strength of the socket.

U.S. Pat. No. 5,782,148 discloses a socket including an end having a driving opening for coupling with a wrench or the like. The other end of the socket includes a dual-depth fastener receiving recess for receiving a fastener. Such a socket can be used in many situations, such as connecting with a pneumatic or electric wrench or used in automatic machines, such as numerical controlled machines, for tightening or loosening fasteners of a workpiece. However, the fastener receiving recess of the socket is liable to crack in corners thereof due to repeated impact and collision with fasteners. The tightening torque of the socket is insufficient if the socket has cracks. In addition, the socket with cracks may injure workers or even cause damage to the workpiece or the machine. Frequent replacement of the socket is inevitable, resulting in an increase in costs.

Thus, a need exists for a reinforced socket to reduce costs while increasing strength.

BRIEF SUMMARY OF THE INVENTION

The present invention solves this need and other problems in the field of durable sockets by providing a socket including a body and a sleeve. The body is made of metal and includes a first coupling end and a second coupling end opposite to the first coupling end. The first coupling end includes an actuating hole extending along a longitudinal axis of the body and having non-circular cross sections. The actuating hole is adapted to couple with a fastener. The second coupling end includes a driving hole extending along the longitudinal axis of the body and having non-circular cross sections. The driving hole is adapted to couple with a driving tool. The first coupling end includes an outer periphery having a first protruded section, a second protruded section, and an engagement section extending between the first and second protruded sections. The sleeve is made of metal having a hardness greater than a hardness of the body. The sleeve includes first and second end faces and an inner periphery extending between the first and second end faces of the sleeve. The inner periphery of the sleeve includes an engagement portion engaged with the engagement section of the body, with the sleeve not contacting the first and second protruded sections of the body.

Preferably, the second end face of the sleeve is located between the first end face of the sleeve and the second protruded section of the body, and with the first end face not contacting the first protruded section, with the second end face of the sleeve facing but not contacting the second protruded section.

Preferably, a length of the engagement section of the body along the longitudinal axis of the body is larger than a length of the engagement portion of the sleeve along the longitudinal axis of the body. A gap is formed between the first end face and the first protruded section, and another gap is formed between the second end face and the second protruded section.

Preferably, the engagement portion of the sleeve has an initial inner diameter before the sleeve is mounted on the body. The initial inner diameter is slightly smaller than an outer diameter of the engagement section perpendicular to the longitudinal axis of the body. The engagement portion of the sleeve is mounted around the engagement section of the body by tight coupling, avoiding the sleeve from disengaging from the body.

Preferably, the outer diameter of the engagement section of the body is smaller than the maximum diameter of the first protruded section perpendicular to the longitudinal axis of the body and smaller than the maximum diameter of the second protruded section perpendicular to the longitudinal axis of the body.

Preferably, the maximum diameter of the first protruded section of the body is smaller than the maximum diameter of the second protruded section of the body.

Preferably, the first protruded section includes an annular ridge, with the annular ridge defining the maximum diameter of the first protruded section. The first protruded section further includes a connection face extending between the annular ridge and an end of the engagement section, with the connection face having increasing diameters from the end of the engagement section towards the annular ridge.

Preferably, the second protruded section includes an inner peripheral edge contiguous to the other end of the engagement section of the body, an outer peripheral edge, and a peripheral face between the inner and outer peripheral edges, with the second protruded section having increasing diameters from the inner peripheral edge towards the outer peripheral edge, with the outer peripheral edge defining the maximum diameter of the second protruded section.

Preferably, the first coupling end includes an end face having inner and outer peripheral edges, with the inner peripheral edge of the end face located at an opening of the actuating hole. The first protruded section further includes a guiding face extending between the outer peripheral edge of the end face of the first coupling end and the annular ridge, with the guiding face having decreasing diameters from the annular ridge towards the end face of the first coupling end.

Preferably, the guiding face is conical and includes an inner peripheral edge contiguous to the outer peripheral edge of the end face. A diameter of the inner peripheral edge of the guiding face perpendicular to the longitudinal axis is smaller than the outer diameter of the engagement section. The guiding face further has an outer peripheral edge contiguous to the annular ridge. An inner diameter of the second end face of the sleeve perpendicular to the longitudinal axis is larger than the diameter of the inner peripheral edge of the guiding face.

Preferably, the inner periphery of the sleeve includes a rounded section extending between an inner peripheral edge of the first end face and the engagement portion. The engagement portion extends between the rounded section and the second end face. The second coupling end includes an outer periphery connected to the outer periphery of the first coupling end.

Preferably, the sleeve includes a first thickness between the engagement portion and an outer periphery of the sleeve. The first coupling end of the body has a second thickness between the engagement section and an inner periphery of the first coupling end, with the first thickness larger than the second thickness.

Preferably, the outer periphery of the sleeve has an outer diameter equal to the maximum diameter of the second protruded section of the body perpendicular to the longitudinal axis, with the outer periphery of the sleeve flush with an outer periphery of the second protruded section of the body.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
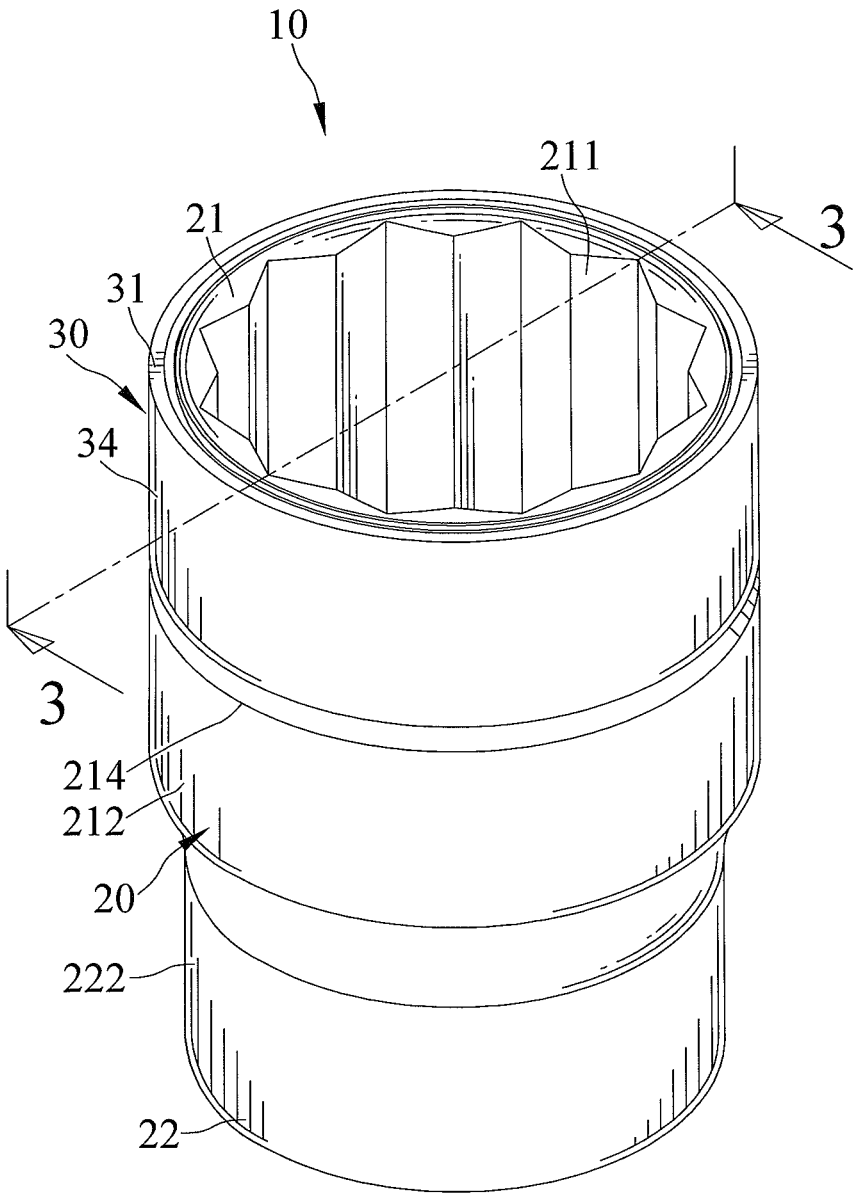
FIG. 1 shows a perspective view of a socket with a reinforced strength according to the present invention.

All figures are drawn for ease of explanation of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "inner", "outer", "edge", "end", "portion", "section", "longitudinal", "annular", "length", "thickness", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

Figure 2:
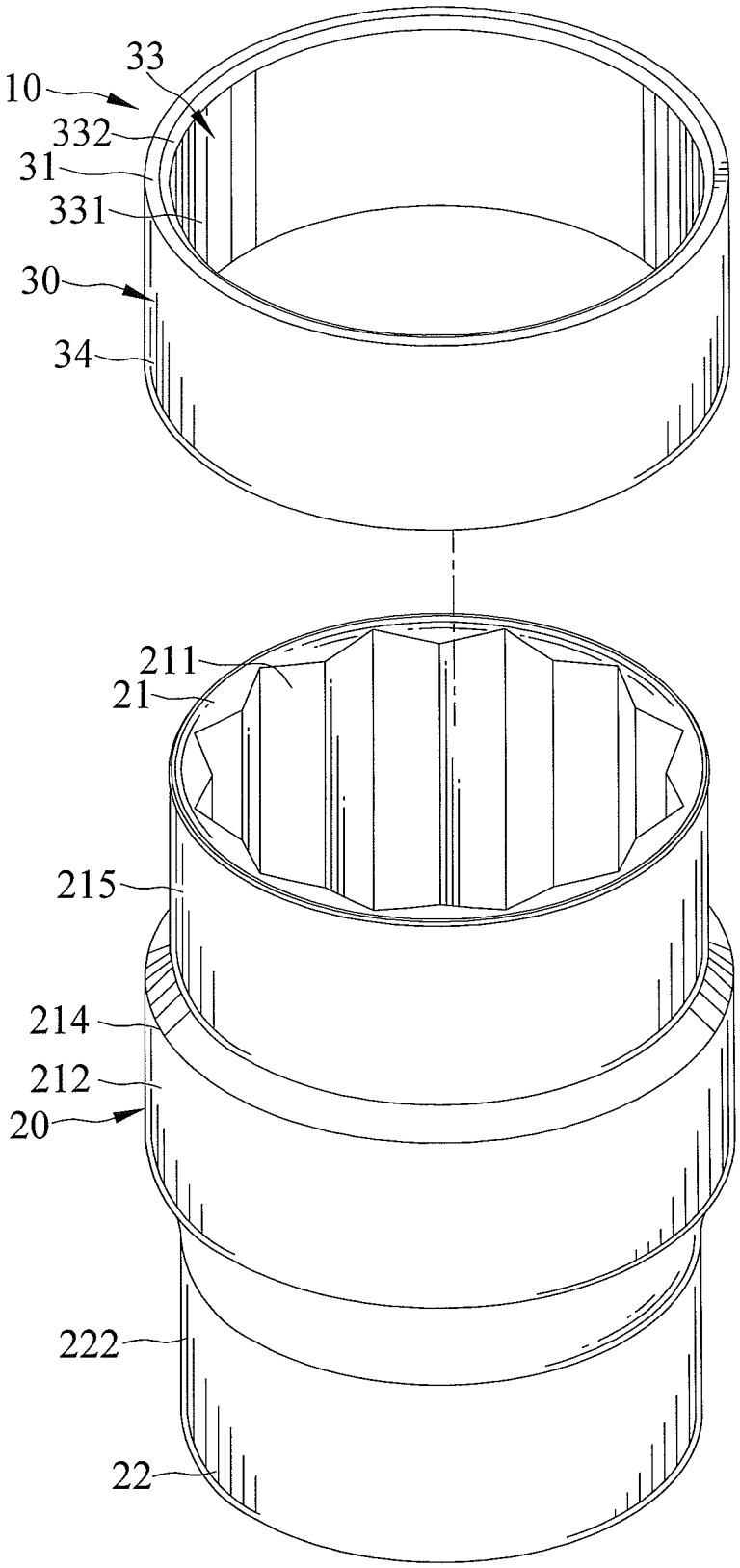
FIG. 2 shows an exploded, perspective view of the socket of FIG. 1.
Figure 3:
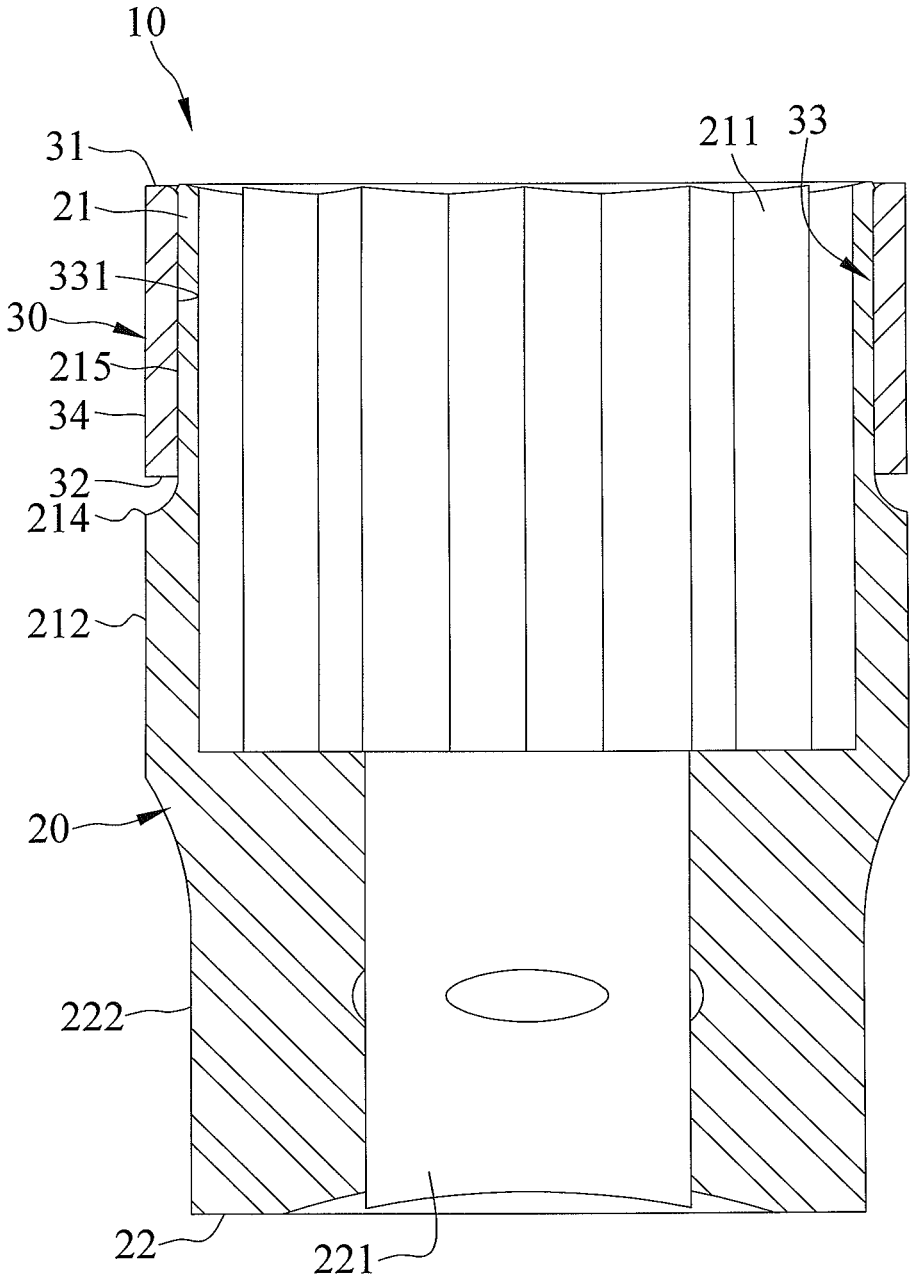
FIG. 3 shows a cross sectional view taken along section line 3-3 of FIG. 1.
Figure 4:
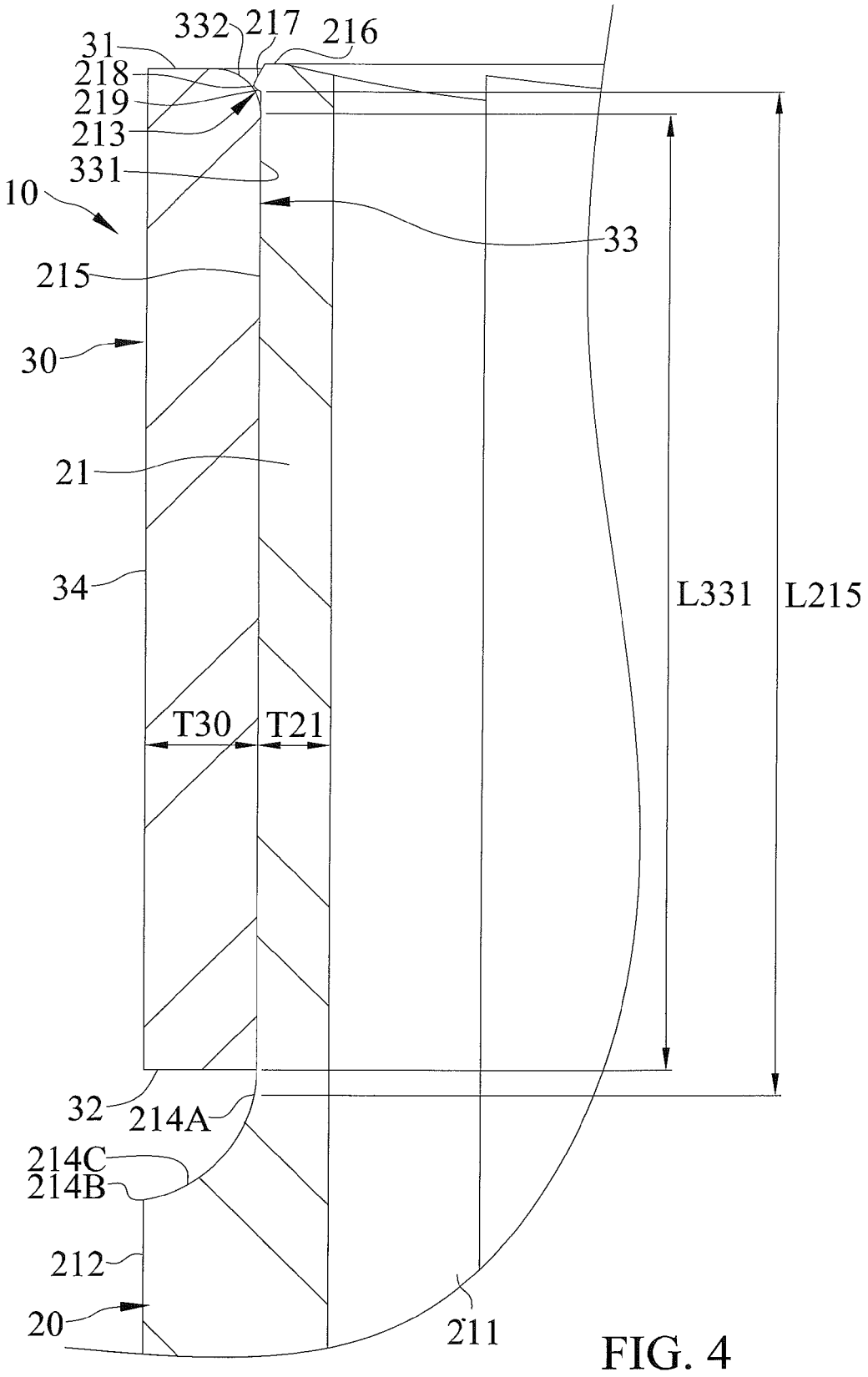
FIG. 4 shows an enlarged view of a portion of the socket of FIG. 3.

With reference to FIGS. 1-4, a socket 10 with a reinforced strength according to the present invention includes a body 20 and a sleeve 30. The body 20 is made of metal and includes a first coupling end 21 and a second coupling end 22 opposite to the first coupling end 21. The first and second coupling ends 21 and 22 can couple with a driving tool or a fastener. The driving tool can be a hand tool, a pneumatic tool, or an electric tool. The fastener can be a hexagonal bolt or nut.

The first coupling end 21 includes an actuating hole 211 extending along a longitudinal axis of the body 20 and having non-circular cross sections. The actuating hole 211 is adapted to couple with a hexagonal fastener. The second coupling end 22 includes a driving hole 221 extending along the longitudinal axis of the body 20 and having non-circular cross sections. The driving hole 221 is adapted to couple with a driving tool having a square head.

The first coupling end 21 of the body 20 includes an outer periphery 212. The second coupling end 22 of the body 20 includes an outer periphery 222 connected to the outer periphery 212 of the first coupling end 21.

The outer periphery 212 of the first coupling end 21 includes a first protruded section 213, a second protruded section 214, and an engagement section 215 extending between the first and second protruded sections 213 and 214. In the form shown, the first protruded section 213 includes an annular ridge 218 defining the maximum diameter of the first protruded section 213. The first protruded section 213 further includes a connection face 219 extending between the annular ridge 218 and an end of the engagement section 215. The connection face 219 has increasing diameters from the end of the engagement section 215 towards the annular ridge 218. The first protruded section 213 further includes a guiding face 217 extending between an end face 216 of the first coupling end 21 and the annular ridge 218. The guiding face 217 has decreasing diameters from the annular ridge 218 towards the end face 216 of the first coupling end 21. The end face 216 includes an inner peripheral edge at an opening of the actuating hole 211. The guiding face 217 is conical and includes an inner peripheral edge contiguous to an outer peripheral edge of the end face 216. The guiding face 217 further includes an outer peripheral edge contiguous to the annular ridge 218. The outer diameter of the inner peripheral edge of the guiding face 217 perpendicular to the longitudinal axis is smaller than an outer diameter of the engagement section 215. The outer diameter of the engagement section 215 perpendicular to the longitudinal axis is smaller than the maximum diameter of the first protruded section 213 and smaller than the maximum diameter of the second protruded section 214 perpendicular to the longitudinal axis of the body 20. Thus, the first and second protruded sections 213 and 214 protrude beyond the engagement section 215 in a radial direction perpendicular to the longitudinal axis.

The second protruded section 214 includes an inner peripheral edge 214A contiguous to the other end of the engagement section 215 of the body 20, an outer peripheral edge 214B, and a peripheral face 214C between the inner and outer peripheral edges 214A and 214B. The second protruded section 214 has increasing diameters from the inner peripheral edge 214A towards the outer peripheral edge 214B. The outer peripheral edge 214B defines the maximum diameter of the second protruded section 214. The peripheral face 214C has two arcs in longitudinal cross section, with each arc representing a quarter of a circumference of a circle. The maximum diameter of the first protruded section 213 is smaller than the maximum diameter of the second protruded section 214 and slightly larger than the outer diameter of the engagement section 215.

The sleeve 30 is made of metal having has a hardness greater than a hardness of the body 20. The sleeve 30 is mounted around the outer periphery 212 of the body 20 to reinforce the strength of the socket 10. The sleeve 30 includes first and second end faces 31 and 32 and an inner periphery 33 extending between the first and second end faces 31 and 32 of the sleeve 30.

The inner periphery 33 of the sleeve 30 includes an engagement portion 331 engaged with the engagement section 215 of the body 20, with the sleeve 30 not contacting the first and second protruded sections 213 and 214 of the body 20.

The second end face 32 of the sleeve 30 is located between the first end face 31 of the sleeve 30 and the second protruded section 214 of the body 20. The first end face 31 does not contact the first protruded section 213. The second end face 32 of the sleeve 30 faces but does not contact the second protruded section 214.

The engagement portion 331 of the sleeve 30 has an initial inner diameter before the sleeve 30 is mounted on the body 20. The initial inner diameter is slightly smaller than the outer diameter of the engagement section 215 perpendicular to the longitudinal axis of the body 20. The engagement portion 331 of the sleeve 30 is mounted around the engagement section 215 of the body 20 by tight coupling, avoiding the sleeve 30 from disengaging from the body 20. A length L215 of the engagement section 215 of the body 20 along the longitudinal axis of the body 20 is larger than a length L331 of the engagement portion 331 of the sleeve 30 along the longitudinal axis of the body 20, with a gap formed between the first end face 31 and the first protruded section 213, with another gap formed between the second end face 32 and the second protruded section 214.

In assembly, the sleeve 30 is moved (such as by hammering or by a machine) from the first coupling end 21 towards the second coupling end 22 of the body 20 with the second end face 32 of the sleeve 30 facing the body 20. Since the initial inner diameter of the engagement portion 331 of the sleeve 30 is slightly smaller than the outer diameter of the engagement section 215, the first protruded section 213 is squeezed inward by the engagement portion 331 during assembly. After the engagement portion 331 of the sleeve 30 passes through the first protruded section 213, the first protruded section 213 returns to its initial shape by restitution of the first coupling end 21. Thus, the engagement portion 331 of the sleeve 30 is tightly coupled around the engagement section 215 of the body 20 without the risk of disengagement.

An inner diameter of the second end face 32 of the sleeve 30 perpendicular to the longitudinal axis is larger than the diameter of the inner peripheral edge of the guiding face 217, such that the guiding face 217 guides the second end face 32 of the sleeve 30 to easily pass through the first protruded section 213. Thus, the sleeve 30 can smoothly move to the engagement section 215 of the body 20.

The inner periphery 33 of the sleeve 30 includes a rounded section 332 extending between an inner peripheral edge of the first end face 31 and the engagement portion 331, with the engagement portion 331 extending between the rounded section 332 and the second end face 32. This rounded section 332 assures the first protruded section 213 returns to its initial shape, while avoiding the first end face 31, the engagement portion 331, and the rounded section 332 from contacting the first protruded section 213.

Since the hardness of the sleeve 30 is greater than that of the body 20, the structural strength of the socket 10 is increased. This reduces the deformation of the actuating hole 211 of the first coupling end 21 during operation. Even if the actuating hole 211 of the first coupling end 21 cracks in the corners due to repeated impact and collision with fasteners, the sleeve 30 still envelopes the first coupling end 21 of the body 20, such that the actuating hole 211 can still perform the desired driving function, reducing damage and providing desired tightening torque. Thus, the socket 10 has a longer service life.

By tight coupling between the engagement section 215 of the body 20 and the engagement portion 331 of the sleeve 30 slightly smaller than the engagement section 215 and by avoiding the sleeve 30 from contacting the first and second protruded sections 213 and 214, the assembly is completed as soon as the sleeve 30 completely passes through the first protruded section 213. The assembling precision requirement is not high, such that the assembly can be accomplished without professional workers. Furthermore, the outer periphery 34 of the sleeve 30 is intact, keeping the color, patterns, words, matted surface effect, or mirror finished surface effect.

Furthermore, since the hardness of the sleeve 30 is greater than that of the body 20, the body 20 can be made of a metal having a low cost. The socket 10 still has a sufficient strength after the hard sleeve 30 is mounted around the body 20, effectively prolonging the service life.

The sleeve 30 includes a first thickness T30 between the engagement portion 331 and an outer periphery 34 of the sleeve 30. The first coupling end 21 of the body 20 has a second thickness T21 between the engagement section 215 and an inner periphery of the first coupling end 21, with the first thickness T30 larger than the second thickness T21. Thus, the thickness T30 of the sleeve 30 can reinforce the socket 10, such that the first coupling end 21 of the body 20 can be made as thin as possible, saving material and effectively reducing the diameter of the socket 10, while reducing the weight and the size and allowing operation in a limited space. In the form shown, the outer periphery 34 of the sleeve 30 has an outer diameter equal to the maximum diameter of the second protruded section 214 of the body 20, such that the outer periphery 34 of the sleeve 30 is flush with the outer peripheral edge 214B of the second protruded section 214 of the body 20, avoiding the outer periphery 34 of the sleeve 30 from protruding beyond the second protruded section 214.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A socket comprising:

a body made of metal, with the body including a first coupling end and a second coupling end opposite to the first coupling end, with the first coupling end including an actuating hole extending along a longitudinal axis of the body, with the actuating hole including non-circular cross sections, with the actuating hole adapted to couple with a fastener, with the second coupling end including a driving hole extending along the longitudinal axis of the body, with the driving hole having non-circular cross sections, with the driving hole adapted to couple with a driving tool, with the first coupling end including an outer periphery having a first protruded section, a second protruded section, and an engagement section extending between the first and second protruded sections; and a sleeve made of metal having a hardness greater than a hardness of the body, with the sleeve including first and second end faces and an inner periphery extending between the first and second end faces of the sleeve, with the inner periphery of the sleeve including an engagement portion engaged with the engagement section of the body, with the engagement portion of the sleeve having an initial inner diameter before the sleeve is mounted on the body, with the initial inner diameter slightly smaller than an outer diameter of the engagement section perpendicular to the longitudinal axis of the body, with the engaging portion of the sleeve not contacting the first and second protruded sections of the body, with the sleeve including a first thickness between the engagement portion and an outer periphery of the sleeve, with the first coupling end of the body having a second thickness between the engagement section and an inner periphery of the first coupling end, with the first thickness larger than the second thickness, with the engagement portion of the sleeve mounted around the engagement section of the body by tight coupling, avoiding the sleeve from disengaging from the body.

2. The socket as claimed in claim 1, with the second end face of the sleeve located between the first end face of the sleeve and the second protruded section of the body, with the first end face not contacting the first protruded section, with the second end face of the sleeve facing but not contacting the second protruded section.

3. The socket as claimed in claim 2, with a length of the engagement section of the body along the longitudinal axis of the body larger than a length of the engagement portion of the sleeve along the longitudinal axis of the body, with a gap formed between the first end face and the first protruded section, with another gap formed between the second end face and the second protruded section.

4. The socket as claimed in claim 1, with the outer diameter of the engagement section of the body smaller than a maximum diameter of the first protruded section perpendicular to the longitudinal axis of the body and smaller than a maximum diameter of the second protruded section perpendicular to the longitudinal axis of the body.

5. The socket as claimed in claim 4, with the maximum diameter of the first protruded section of the body smaller than the maximum diameter of the second protruded section of the body.

6. The socket as claimed in claim 5, with the first protruded section including an annular ridge, with the annular ridge defining the maximum diameter of the first protruded section, with the first protruded section further including a connection face extending between the annular ridge and an end of the engagement section, with the connection face having increasing diameters from the end of the engagement section towards the annular ridge.

7. The socket as claimed in claim 6, with the second protruded section including an inner peripheral edge contiguous to another end of the engagement section of the body, an outer peripheral edge, and a peripheral face between the inner and outer peripheral edges, with the second protruded section having increasing diameters from the inner peripheral edge towards the outer peripheral edge, with the outer peripheral edge defining the maximum diameter of the second protruded section.

8. The socket as claimed in claim 6, with the first coupling end including an end face having inner and outer peripheral edges, with the inner peripheral edge of the end face located at an opening of the actuating hole, with the first protruded section further including a guiding face extending between the outer peripheral edge of the end face of the first coupling end and the annular ridge, with the guiding face having decreasing diameters from the annular ridge towards the end face of the first coupling end.

9. The socket as claimed in claim 8, with the guiding face being conical and including an inner peripheral edge contiguous to the outer peripheral edge of the end face, with a diameter of the inner peripheral edge of the guiding face perpendicular to the longitudinal axis smaller than the outer diameter of the engagement section, with the guiding face further having an outer peripheral edge contiguous to the annular ridge, with an inner diameter of the second end face of the sleeve perpendicular to the longitudinal axis larger than the diameter of the inner peripheral edge of the guiding face.

10. The socket as claimed in claim 9, with the inner periphery of the sleeve including a rounded section extending between an inner peripheral edge of the first end face and the engagement portion, with the engagement portion extending between the rounded section and the second end face, with the second coupling end including an outer periphery connected to the outer periphery of the first coupling end.

11. The socket as claimed in claim 1, with the outer periphery of the sleeve having an outer diameter equal to a maximum diameter of the second protruded section of the body perpendicular to the longitudinal axis, with the outer periphery of the sleeve flush with an outer periphery of the second protruded section of the body.

* * * * *